United States Patent [19]

Onoda et al.

[11] Patent Number: 4,839,690

[45] Date of Patent: Jun. 13, 1989

[54] IMAGE BEARING MEMBER USABLE WITH IMAGE FORMING APPARATUS

[75] Inventors: Shigeyoshi Onoda, Yokohama; Tokihide Ebata, Tanashi, both of Japan

[73] Assignee: Canon Kabushiki Kaisha, Tokyo, Japan

[21] Appl. No.: 201,365

[22] Filed: May 26, 1988

Related U.S. Application Data

[63] Continuation of Ser. No. 906,032, Sep. 10, 1986, abandoned.

[30] Foreign Application Priority Data

Sep. 17, 1985 [JP] Japan ..... 60-141595[U]
Sep. 17, 1985 [JP] Japan ..... 60-205102

[51] Int. Cl.[4] ..... G03G 15/00

[52] U.S. Cl. ..... 355/211; 355/219; 339/258 R

[58] Field of Search ..... 355/3 DR, 3 R; 339/258 R

[56] References Cited

U.S. PATENT DOCUMENTS

| | | | |
|---|---|---|---|
| 3,455,276 | 7/1969 | Anderson | 118/637 |
| 4,344,700 | 8/1982 | Kasama et al. | 355/3 DR |
| 4,561,763 | 12/1985 | Basch | 355/3 DR |
| 4,575,221 | 3/1986 | Onoda et al. | 355/3 DR |
| 4,591,258 | 5/1986 | Nishino et al. | 355/3 R |
| 4,607,937 | 8/1986 | Minami | 355/3 |

FOREIGN PATENT DOCUMENTS

| | | |
|---|---|---|
| 0096261 | 12/1983 | European Pat. Off. . |
| 136902 | 4/1985 | European Pat. Off. . |
| 1752408 | 11/1971 | Fed. Rep. of Germany . |
| 2406162 | 6/1975 | Fed. Rep. of Germany . |
| 57-161772 | 10/1982 | Japan . |
| 1487588 | 10/1977 | United Kingdom . |
| 1490770 | 11/1977 | United Kingdom . |

*Primary Examiner*—R. L. Moses

*Attorney, Agent, or Firm*—Fitzpatrick, Cella, Harper & Scinto

[57] ABSTRACT

An image bearing member which is detachably mounted into a main assembly, and which is to be electrically connected with the main assembly. The image bearing member has a conductive drum member having an insulating flange. Adjacent an inside end of the insulating flange, a conductive member is provided in the manner it is electrically connected to an inner surface of the conductive drum member. The conductive member is electrically connected with a conductive member of a main assembly when the image bearing member is mounted in the main assembly.

19 Claims, 4 Drawing Sheets

IMAGE BEARING MEMBER USABLE WITH IMAGE FORMING APPARATUS

This application is a continuation of application Ser. No. 906,032 filed Sept. 10, 1986, now abandoned.

FIELD OF THE INVENTION AND RELATED ART

The present invention relates to an image bearing member such as a photosensitive drum and an insulating drum, usable with an electrophotographic copying machine or electrostatic recording machine, more particularly, a mechanism for electrically connecting the image bearing member with an associated main assembly of the apparatus, wherein on the surface of the image bearing member a latent image or toner image is formed.

In one method of producing a small size image bearing drum, an impact formation is used wherein one longitudinal end of the drum is closed during the formation, so that it is formed into a shape of a cup. When such a shape of the drum is used as a photosensitive drum, a part of the end can be formed into a shaft, which is utilized for electrically connecting the photosensitive drum to an external machine.

However, when the size, more particularly diameter of the drum is reduced, which is a recent trend, it is not possible to close one longitudinal end in the impact formation.

SUMMARY OF THE INVENTION

Accordingly, it is a principal object of the present invention to provide an image bearing member which can be electrically connected to an external assembly in the case where the diameter of the drum is reduced.

It would be easy to establish the electrical connection by employing a metal flange at the end of the drum. However, this results in the increase of the weight and the manufacturing cost.

Therefore, it is another object of the present invention to provide an image bearing drum which does not use a flange of a metal.

It is a further object of the present invention to provide a mechanism for establishing electrical connection, which has a minimum length measured in the direction perpendicular to the direction of movement of the image bearing member.

According to an embodiment of the present invention, there is provided an image bearing member usable with an image forming apparatus, comprising an electrically conductive drum member supporting thereon an image bearing layer; an electrically insulative flange mounted adjacent an end of said conductive drum member; and an electrically conductive member, engageable with an electrically conductive member of the image forming apparatus, disposed at an inner side of said flange and engaged to a part of the conductive drum.

The image bearing member may in the form of a drum or cylinder comprising a conductive base and an image bearing member or in the form of an insulating drum comprising an insulating or dielectric layer, or may be a combination of such an image bearing member in the form of a belt and a roller or drum for supporting such a belt.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
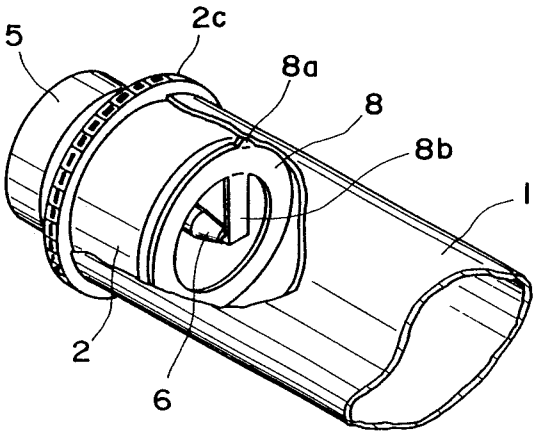
FIG. 1, is a partly broken perspective view of an image bearing member (a photosensitive drum) according to an embodiment of the present invention.
Figure 2:
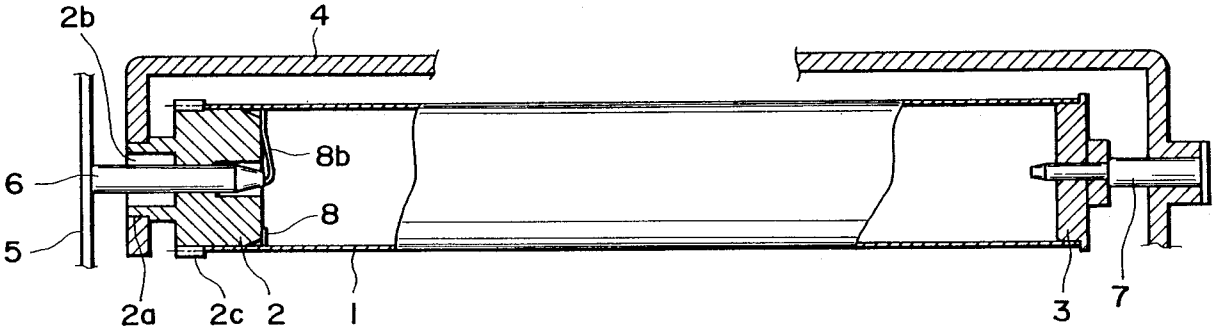
FIG. 2 is a sectional view illustrating the relationship between the photosensitive drum of FIG. 1 and a main assembly in which the photosensitive drum is mounted.
Figure 3:
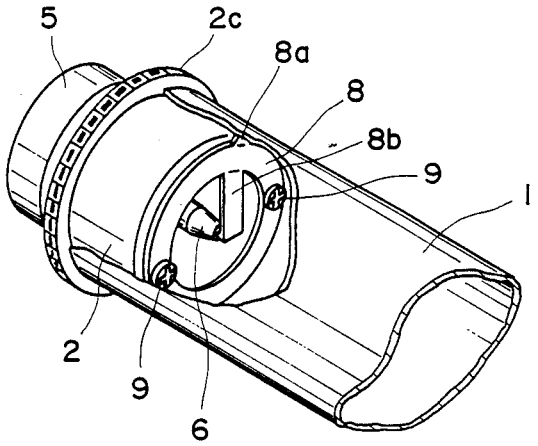
FIG. 3 is a partly broken perspective view illustrating the conductive plate.

Referring to FIG. 1, there is shown a part of a photosensitive drum employing an electrical contact establishing mechanism according to an embodiment of the present invention, in a partly broken perspective view. FIG. 2 illustrates the connection with the main assembly to which the photosensitive drum is set. In this embodiment, the photosensitive drum is built in a process cartridge as disclosed in U.S. Pat. No. 4,575,221.

The photosensitive drum 1 is in the form of a drum or cylinder having both ends opened. It is made of aluminum and has a diameter of 30 mm. To each of the ends, a resin flange 2 or 3 of polyacetal resin or polycarbonate resin is mounted. One of the resin flanges 2 is provided with an engaging portion 2*a* at which the flange is journaled in the cartridge housing 4, whereby the drum 1 is supported in the cartridge housing 4. The resin flange 2 is also provided with a bore 2*b* which is effective to receive a positioning pin 6 of the main assembly, which pin 6 is mounted to and electrically connected with a side plate 5 of the main assembly. By the receiving engagement, the cartridge is supported to the main assembly. The other flange 4 supports the photosensitive drum 1 on the cartridge housing 4 through another positioning pin 7.

The photosensitive drum 1 is driven by a gear of the main assembly by an engagement with the gear of the main assembly and the gear portion 2*c* integrally formed with the flange 2.

A conductive plate 8 serves to electrically connect the drum 1 with an external portion, more particularly, to ground the drum 1 in this embodiment. The conductive plate is made of steel, copper phosphor bronze or stainless steel in the form of a thin plate. The conductive plate 8 is securedly fitted to an internal wall of the photosensitive drum 1 so that the electrical connection is established with the drum, and simultaneously, the position of the conductive plate 8 is fixed. The conductive plate is stamped to form a leaf spring portion 8*b*. When the cartridge is mounted in the main assembly, the leaf spring 8*b* is contacted to a free end of the positioning pin 6 of the main assembly, whereby the electrical connection is established between the metal portion of the photosensitive drum 1 and the main assembly.

The conductive plate 8 is properly mounted by fixing it to the flange 2, before the resin flange 2 is mounted into the drum, by a screw or screws 9 or by clamping the conductive plate 8 by deforming the resin part by heat. By doing so, the positioning and fixing of the conductive plate 8 is assured.

Figure 4:
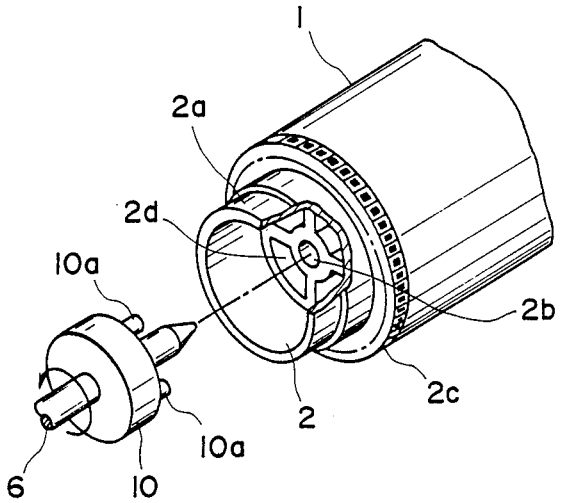
FIG. 4 is a perspective view of another example of a flange.

FIG. 4 shows another example of driving mechanism of the drum 1, wherein the gear portion 2c of the flange 2 of FIG. 1 example is not used. In the example of FIG. 4, a transmission element 10 is fixed on the pin 6. The transmission element 10 has a projection or projections 10a which is engageable with a recess or recesses 2d formed in the resin flange 2, so that the drum 1 is driven by the positioning pin 6 which rotates. This will be further described.

Figure 5:
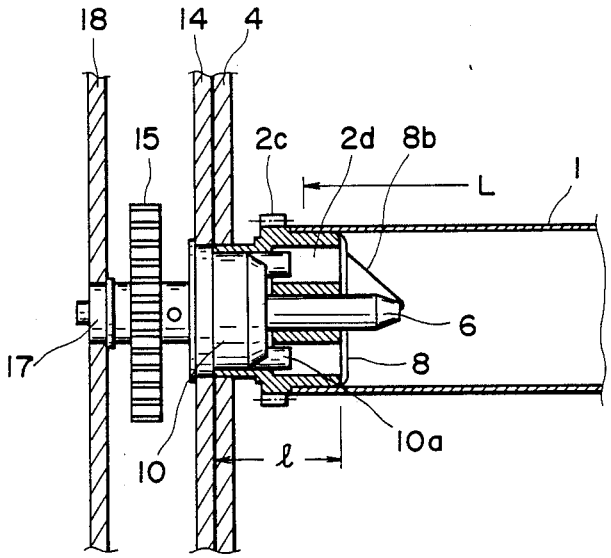
FIGS. 5 and 6 are sectional views illustrating the establishment of electrical connection.
Figure 6:
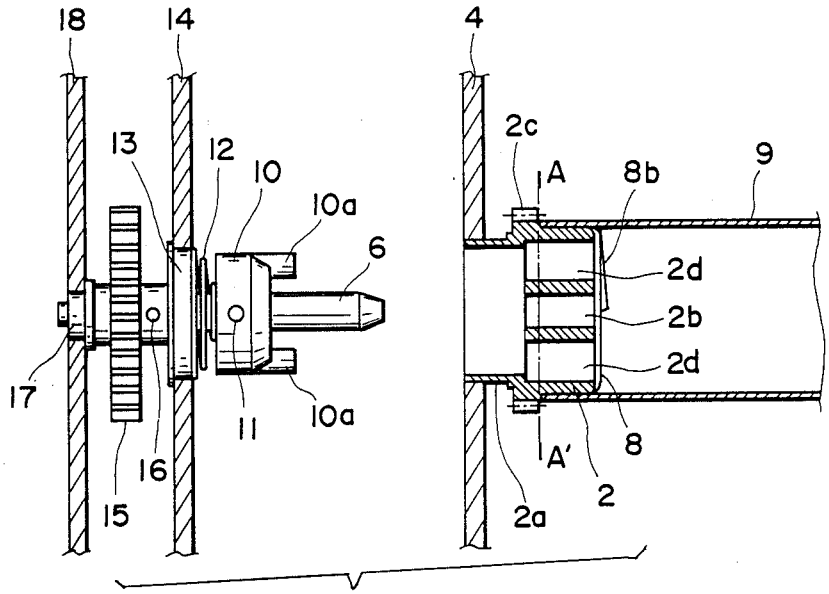

Referring to FIGS. 5 and 6, the main assembly of the image forming apparatus, which is an electrophotographic machine in this embodiment, comprises a driving shaft 6 which functions to transmit a driving force to the process cartridge and also to position the drum 1 of the processcartridge. A transmission element 10 is mounted on the driving shaft 6 by parallel pins 11, wherein the transmission element 10 is not rotatable relative to the driving shaft 6 but is slidable thereon. The transmission element 10 has two projections 10a. The transmission element 10 is urged toward the drum by a spring 12. The driving shaft 6 is supported by a bearing 13 which is mounted to a fixed side plate 14 of the main assembly. The driving shaft 6 is driven by a driving source of the main assembly through a driving gear 15. The driving gear 15 is mounted on the driving shaft 6, wherein the gear 15 is not rotatable relative to the driving shaft 6, but is slidable thereon. The driving shaft 6 is further supported by a bearing 17 which is mounted to a fixed side plate 18 of the main assembly. The photosensitive drum 1 of the process cartridge has a resin flange 2 which is pressure-fitted into the photosensitive drum 1. A conductive plate 8 is effective to apply a bias voltage to the photosensitive drum from the main assembly by way of the driving shaft 6 in the manner described above. The bias voltage may be the ground level. The conductive plate 8 is fixed to the resin flange and is also engaged to the internal surface of the photosensitive drum 1.

As will be understood from the Figures, the drum gear 2c is located at such a position that it does not extend out of the cartridge housing 4. The drum gear 2c is used to transmit the driving force to another means in the process cartridge, such as a developing device or a cleaning device (not shown).

When the process cartridge is mounted into the copying apparatus, the driving shaft 6 of the main assembly is inserted into the central bore 2b of the resin flange so that the drum 1 is correctly positioned with respect to the main assembly, and so that the free end of the driving shaft 6 pushes the leaf spring 8b of the conductive plate 8 and is pressure-contacted thereto. The two projections 10a of the transmission element 10 is pushed into the recesses 2a at the inside part of the resin flange 2 by the spring 12. When the driving source of the main assembly operates, the driving force is transmitted to the gear 15 to rotate the drive transmission element 10 which is engaged to the driving shaft 6 by the parallel pins 11. The projections 10a of the transmission element 10 rotates the resin flange 2, and therefore, the photosensitive drum 1 which is fixed to the flange 2. During the rotation of the photosensitive drum 1, the flange 2 rotationally slides in the process cartridge housing 4 at the bearing portions.

FIG. 6 illustrates the state in which the process cartridge is being mounted into the copying apparatus. FIG. 5 illustrates the state in which it has been set in place therein.

As will be understood from the Figures, in this embodiment, the conductive plate 8 mounted to the resin flange is at such a position which is away from the external surface of the wall of the cartridge housing 4 by a distance 1. The image bearing member 1 has a region L in which an image can be formed or carried. When the cartridge is mounted in the main assembly, the driving shaft 6 of the main assembly extends into the image forming region L. In other words, the conductive plate 8 and its leaf spring 8b is within the image forming region L of the image bearing member. By this arrangement, the total length of the photosensitive drum 1 including the necessary elements, is reduced as compared with conventional arrangements. As a result, the size of the process cartridge can be reduced.

In the foregoing embodiment, the insulating flange 2 is made of a resin. However, it is possible to use processed paper, ceramic, processed wood or the like.

The electric connection may be to ground the image bearing member or to apply a positive or negative voltage thereto.

As for the image bearing drum, it may be built in the process cartridge or may be a drum itself. The image bearing member may be an insulating drum having a surface layer capable of retaining electric charge.

In the embodiment described above, the photosensitive drum 1 is an electrophotographic photosensitive member, around which charging means, image exposure means, developing means, image transfer means and cleaning means are disposed in the order named, which may be of any known type. The detailed description of those means is omitted for the sake of simplicity.

The image bearing member may be of a type wherein an insulating layer or dielectric layer is formed on a conductive base. The shape thereof is not limited to the drum or cylinder, but may be a belt.

Figure 7:
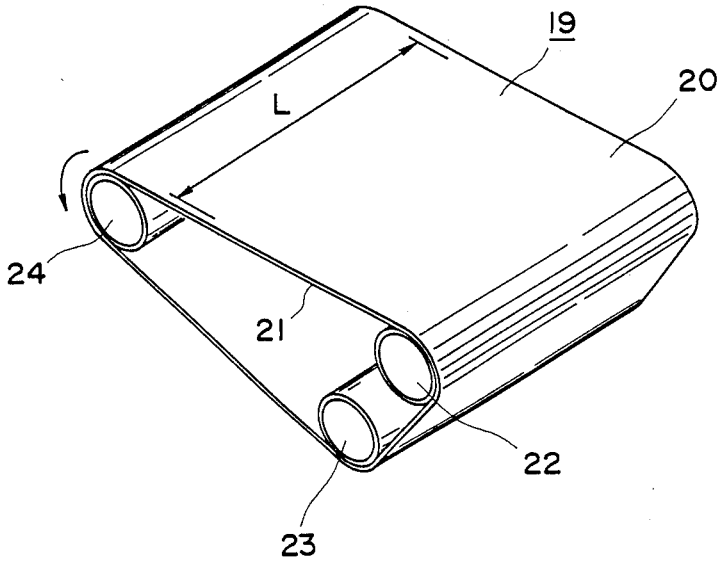
FIG. 7 is a perspective view of another example of the image bearing member, in the form of a combination of a belt and a roller.

FIG. 7 is an example of the image bearing member 1 in the form of a combination of a belt and a roller. An electrophotographic photosensitive belt 19 comprises an electrically conductive base belt 21 of a metal and a photoconductive surface layer 20 thereon. The photosensitive belt 19 is supported around the supporting drums 22, 23 and 24 of a conductive material such as aluminum and stainless steel. At least one of those drums may have the same structure as shown in FIG. 2 or 5, in which case the drum functions as a driving drum, and the other drums function as follower drums. By doing so, the photosensitive belt 19 is capable of being driven. In this case, the driving drum corresponds to the photosensitive drum 1 of the foregoing embodiment, the electrical connection is established by the conductive plate 8 of FIG. 2 or 5 through the driving drum with the main assembly.

In this case, similarly to the case of the image bearing member in the form of a drum, the conductive plate 8 is disposed within the width of the belt in the direction perpendicular to the movement of the belt. Thus, both of the flange 2 and the conductive plate 2 is disposed within the image forming region of the image bearing member, so that the width or length of the image bearing member is minimized, allowing efficient use of the space.

As will be understood, according to the present invention, the flange portion can be formed by a separate member from the drum, and therefore, the latitude of selection of the shape and material of the flange is increased. Also, since the flange may be of an insulating material, the weight and the manufacturing cost of the flange is reduced as compared with a metal flange. Further, the conductive member for establishing the necessary electrical connection is disposed inside the conductive drum member, and therefore, the position of the conductive member is relatively free to such an extent that the conductive member may be located within the image forming range of the image bearing member. More particularly, it is not necessary to establish an electrical contact at the surface of the image bearing member, which is effective to minimize the width of the image bearing member.

While the invention has been described with reference to the structures disclosed herein, it is not confined to the details set forth and this application is intended to cover such modifications or changes as may come within the purposes of the improvements or the scope of the following claims.

What is claimed is:

1. An image bearing member usable with an image forming apparatus, comprising:

an electrically conductive drum member having first and second ends and supporting thereon an image bearing layer;

an electrically insulative flange mounted adjacent said first end of said conductive drum member; and a first electrically conductive member, engageable with a second electrically conductive member of the image forming apparatus, disposed at a inner side of said flange and engaged to a part of the conductive drum, wherein said first electrically conductive member includes an arcuate portion substantially concentric with an interior portion of said conductive drum, a projection extending from said arcuate portion and contacting said interior portion of said conductive drum, and a spring portion adapted to contact an end of a drum shaft of the image forming apparatus.

2. An image bearing member according to claim 1, wherein said image bearing member comprises said conductive drum member and a photosensitive image bearing layer thereon.

3. An image bearing member according to claim 1, wherein said flange is pressure-fitted into the conducive drum member.

4. An image bearing member according to claim 1, wherein said first conductive member in the conductive drum member is a metal plate and said spring portion is partly cut out therefrom to form a leaf spring which is resiliently engaged to the second conductive member of the image forming apparatus.

5. An image bearing member according to claim 3, wherein said conductive member of said image bearing member is in a region corresponding to a region of said image bearing member usable for image bearing thereon.

6. An image bearing member according to claim 1, wherein said flange functions as a bearing.

7. An image bearing member according to claim 1, wherein said flange is formed integrally with a gear for driving said conductive drum member.

8. A mechanism for establishing electrical connection between an image forming apparatus and an image bearing member having an electrically conductive metal drum member and an image bearing layer formed thereon, comprising:

an electrically insulative resin flange fitted into a first end of the metal drum member; and a first electrically conductive member, engageable with a second electrically conductive member of the image forming apparatus, disposed at an inner side of said flange and engaged to a part of the metal drum member;

wherein said first electrically conductive member includes an arcuate portion substantially concentric with an interior portion of the metal drum member, a projection extending from said arcuate portion and contacting said interior portion of the metal drum member, and a spring portion adapted to contact end of a drum shaft of the image forming member.

9. A mechanism according to claim 8, wherein said first conductive member of said image bearing member is a metal plate and said spring portion is partly cut out therefrom to form a leaf spring which is resiliently engaged to the second conductive member of the image forming apparatus to establish an electrical connection therebetween.

10. A mechanism according to claim 9, wherein said projection extends from a periphery of said metal plate and is provided with a sharp tip which is pressure-fitted against the interior portion of the metal drum member.

11. A mechanism according to claim 6, wherein said first conductive member of the image bearing member is fixed on the resin flange.

12. A mechanism according to claim 8, wherein said conductive member of said image bearing member is in a region corresponding to a region of said image bearing member usable for image bearing thereon.

13. A mechanism according to claim 8, wherein said flange functions as a bearing.

14. An image forming bearing member according to claim 8, wherein said flange is formed integrally with a gear for driving said conductive drum member.

15. A mechanism for establishing an electrical connection between an image forming apparatus and an image bearing member having an electrically conductive metal drum member and an image bearing layer formed thereon, comprising:

an electrically insulative resin flange fitted into a first end of the metal drum member; and a first electrically conductive member, electrically connectable with a second electrically conductive member of the image forming apparatus, disposed at an inner side of said flange and engaged to a part of the metal drum member;

wherein said first electrically conductive member is formed from a thin conductive sheet and includes a projection contacting an interior portion of the metal drum member and a spring portion adapted to contact an end of a drum shaft of the image forming apparatus.

16. A mechanism according to claim 15, wherein said first conductive member is a metal plate and said spring portion is partly cut out therefrom to form a leaf spring which is resiliently engaged to the second conductive member to establish an electrical connection therebetween.

17. A mechanism according to claim 15, wherein said projection extends from a periphery of said thin conductive sheet and is provided with a sharp tie which is pressure-fitted against the interior portion of the metal drum member.

18. A mechanism according to claim 15, wherein said first conductive member is fixed on the resin flange.

19. An image bearing member usable with an image forming apparatus, comprising:

an electrically conductive drum member having first and second ends and supporting thereon an image bearing layer;

an electrically insulative flange mounted adjacent said first end of said conductive drum member; and a first electrically conductive member, engageable with a second electrically conductive member of the image forming apparatus, disposed at an inner side of said flange and engaged to a part of the conductive drum, wherein said image bearing member comprises a conductive drum member and a belt having an image bearing layer trained therearound.

* * * * *

UNITED STATES PATENT AND TRADEMARK OFFICE

CERTIFICATE OF CORRECTION

PATENT NO. : 4,839,690

DATED : June 13, 1989

INVENTOR(S) : SHIGEYOSHI ONODA, ET AL.

It is certified that error appears in the above-identified patent and that said Letters Patent is hereby corrected as shown below:

COLUMN 1

Line 59, "may" should read --may be--.

COLUMN 2

Line 44, "flange 4" should read --flange 3--.

COLUMN 3

Line 18, "processcartridge" should read --process cartridge--.

COLUMN 4

Line 60, "conductive plate 2" should read --conductive plate 8--.

COLUMN 5

Line 30, "a" should read --an--.
Line 55, "said conductive member" should read --said first conductive member--.

UNITED STATES PATENT AND TRADEMARK OFFICE

CERTIFICATE OF CORRECTION

PATENT NO. : 4,839,690

DATED : June 13, 1989

INVENTOR(S) : SHIGEYOSHI ONODA, ET AL.

It is certified that error appears in the above-identified patent and that said Letters Patent is hereby corrected as shown below:

COLUMN 6

Line 14, "end" should read --an end--.
Line 27, "claim 6," should read --claim 8,--.
Line 31, "conductive member" should read --first conductive member--.
Line 36, "An image forming bearing member" should read --A mechanism--.
Line 66, "sharp tie" should read --sharp tip--.

Signed and Sealed this

Twenty-sixth Day of November, 1991

*Attest:*

HARRY F. MANBECK, JR.

*Attesting Officer*

*Commissioner of Patents and Trademarks*